US005469869A

United States Patent [19]

Suzuki et al.

[11] Patent Number: 5,469,869

[45] Date of Patent: Nov. 28, 1995

[54] WEB DELIVERY APPARATUS FOR A CIGARETTE MANUFACTURING MACHINE AND A DELIVERY METHOD THEREFOR

[75] Inventors: Takehiro Suzuki; Shigemitsu Inomata, both of Tokyo; Mikio Komori, Horifune, all of Japan

[73] Assignee: Japan Tobacco Inc., Tokyo, Japan

[21] Appl. No.: 183,768

[22] Filed: Jan. 21, 1994

[30] Foreign Application Priority Data

Jan. 22, 1993 [JP] Japan ..... 5-009079

[51] Int. Cl.[6] ..... A24C 5/18; A24C 5/20

[52] U.S. Cl. ..... 131/60; 131/34; 131/84.1; 242/421.1; 242/421.2; 242/421.7

[58] Field of Search ..... 131/60, 34, 280, 131/84.1; 242/421.1, 421.2, 421.7

[56] References Cited

U.S. PATENT DOCUMENTS

| | | | |
|---|---|---|---|
| 3,123,268 | 3/1964 | Gagg | 131/60 |
| 4,199,118 | 4/1980 | Tetro et al. . | |
| 4,286,757 | 9/1981 | Wirth . | |
| 4,733,673 | 3/1988 | Mattei et al. | 131/84.1 |
| 5,361,783 | 11/1994 | Herburg | 131/60 X |

FOREIGN PATENT DOCUMENTS

| | | |
|---|---|---|
| 1155868 | 6/1969 | United Kingdom . |
| 2250273 | 6/1992 | United Kingdom . |

OTHER PUBLICATIONS

Papier+Kunststoff–Verarbeiter No. 3, Mar. 25, 1990 Frankfurt Am Main, DE "Anforderungen und Auswahlkriterien für Steuer– und Regeleinrichtungen an Abwickelstationen" Dipl.–ing. Peter Schönrock pp. 7–8, 10–11 and 14.

*Primary Examiner*—Jennifer Bahr

[57] ABSTRACT

An apparatus for carrying out a web delivery method is designed so that a web is delivered from a freely rotatable web roll to be supplied to a cigarette manufacturing machine as a pulling roller rotates. This apparatus has a powder brake for applying a braking force to the web roll, a rotary encoder for detecting the number of revolutions of the web roll, a timing sensor for detecting the number of revolutions of the pulling roller, a CPU board for calculating the diameter of the web roll in accordance with detection signals from the rotary encoder and the timing sensor, and a control board for controlling the braking force of the powder brake in accordance with various operation modes of the apparatus and the diameter of the web roll.

17 Claims, 6 Drawing Sheets

WEB DELIVERY APPARATUS FOR A CIGARETTE MANUFACTURING MACHINE AND A DELIVERY METHOD THEREFOR

BACKGROUND OF THE INVENTION

1. Field of the Invention

The present invention relates to an apparatus and a method for delivering a web such as a wrapping paper or packing sheet used in the manufacture of cigarettes or packs.

2. Description of the Related Art

In the manufacture of cigarettes, a paper web delivered from a web roll is supplied to a cigarette manufacturing machine, and runs in one direction in a wrapping section of the machine. At the starting end of the wrapping section, Cut tobacco is fed onto the web. As the paper web runs, the cut tobacco is wrapped in the web, thus forming a continuous cigarette rod. Thereafter, the cigarette rod is cut into individual cigarettes with a predetermined length.

The paper web is delivered as a pulling roller is rotated with the web roll supported for rotation. As the roller rotates in this manner, the web is fed and delivered from the web roll which is rotating.

A braking force is applied to the web roll by means of a mechanical brake, such as a brake band or brake pad, and the web roll is rotated against the braking force. Accordingly, the paper web delivered from the web roll has a predetermined tension.

In order to maintain the quality of the cigarette rod formed in the wrapping section of the cigarette manufacturing machine and improve the yield of production thereof, the tension of the paper web delivered from the web roll should be stabilized. Unless the web tension is stable, the web supplied to the machine may possibly be slackened or caused to run in a zigzag line. Such slackening or meandering of the paper web prevents stable formation of the cigarette rod in the wrapping section, and in the worst case, causes breakage of the web, thereby interrupting the operation of the cigarette manufacturing machine.

In consideration of these circumstances, the paper web delivered from the web roll is expected to have a constant tension. The aforesaid mechanical brake can, however, apply only a fixed braking force to the web roll. As the diameter or mass of the paper web being delivered is reduced, therefore, the web tension also changes.

A further examination of the paper web tension revealed that the tensions varies according to a plurality of operation modes of a delivery apparatus which correspond to the operating conditions of the cigarette manufacturing machine.

In order to adjust the production of the cigarette rod, the cigarette manufacturing machine is operated at high and low speeds. Correspondingly, the delivery apparatus is operated in high- and low-speed modes. The pulling roller is rotated at one peripheral speed in one of these operation modes and at another in the other mode. The difference in the peripheral speed causes variation of the tension of the paper web delivered from the web roll.

The operation modes also include a stopping mode, during which the operation of the delivery apparatus is fully stopped following the high- or low-speed mode, and a suspension mode, in which the delivery of the paper web is in suspension. In the stopping mode, the paper web delivery is stopped as the peripheral speed of the pulling roller is gradually reduced. In doing this, the paper web is slackened unless the web roll is subjected to a braking force corresponding to its rotational mass. Also in the suspension mode, a braking force corresponding to the weight of the web roll should preferably be applied to the roll.

In order to stabilize the tension of the paper web, therefore, the braking force for the web roll should be controlled in consideration of the operation mode of the cigarette manufacturing machine as well as the variation of the mass of the roll.

SUMMARY OF THE INVENTION

The object of the present invention is to provide a web delivery apparatus and a delivery method therefore, in which a proper tension can be applied to a web delivered from a web roll in consideration of the operation mode of a cigarette manufacturing machine as well as the mass of the web roll, thereby preventing the web from being slackened or cut, so that the cigarette manufacturing machine can form the cigarette rod with stability.

The above object is achieved by a web delivery apparatus according to the present invention, which comprises: braking means for applying a braking force to the rotation of a web roll, the braking means being capable of adjusting the braking force; detecting means for detecting the diameter of the web roll; and control means for controlling the braking force applied to the web roll by the braking means, in accordance with operation modes corresponding to the operating conditions of a cigarette manufacturing machine and the diameter of the web roll detected by the detecting means.

According to the delivery apparatus described above, the web roll is rotated against the braking force from the braking means: as a web is delivered from the web roll. When the diameter of the web roll is reduced as the web is delivered, this reduction is detected by the detecting means, and the control means controls the braking force of the braking means in accordance with the result of the detection and the current operation mode.

The operation modes include a running mode in which the web is delivered from the web roll at constant speed, a stopping mode during which the web delivery is stopped following the running mode, and a suspension mode in which the web delivery is in suspension. The running mode includes a high-speed mode in which the web is delivered from the web roll at high speed and a low-speed mode in which the web is delivered from the web roll at low speed. In this case, the stopping mode includes a first mode which starts following the high-speed mode and a second mode which starts following the low-speed mode.

The control means includes braking force reduction patterns determined individually for the modes in accordance with the diameter of the web roll, and setting means for setting the braking force of the braking means in accordance with the reduction pattern for the current mode and the detected diameter of the web roll. The reduction patterns have characteristics, individually, such that the braking force of the braking means is reduced by stages or in a quadratic curve as the diameter of the web roll decreases.

Thus, the braking force of the braking means is set in accordance with the current diameter of the web roll and the reduction patterns for the operation modes, so that a proper tension can be applied to the web delivered from the web roll, thus ensuring stable web supply to the cigarette manufacturing machine. In the stopping mode, moreover, the delivery of the web can be stopped without slackening or cutting the web.

Preferably, the reduction pattern for the highspeed running mode provides a smaller braking force to be set than the one provided by the reduction pattern for the low-speed mode. In this case, a braking force corresponding to the rotational mass of the web roll can be applied to the roll.

Likewise, the reduction pattern for the first stopping mode preferably provides a smaller braking force to be set than the one provided by the reduction pattern for the second stopping mode. In this case, the reduction patterns for the first and second stopping modes have characteristics such that the braking force is reduced in a quadratic curve as the diameter of the web roll decreases.

The braking means includes a roll brake having a braking force for the web roll variable depending on a supply voltage. More specifically, the roll brake may be formed of a powder brake.

In order to obtain the reduction patterns for reducing the braking force by stages, the control means includes a plurality of voltage generator circuits for generating supply voltages, and selecting means for connecting the roll brake and the voltage generator circuit selected in accordance with the reduction pattern of the current operation mode when the current operation mode is the running mode or the suspension mode. In this case, the selecting means includes an adder circuit connected to the voltage generator circuits by means of connecting lines, individually, and connected electrically to the roll brake, and switch circuits arranged individually in the connecting lines, the adder circuit adding up the supply voltages from the voltage generator circuits and delivering the sum of the supply voltages to the roll brake.

In order to obtain the reduction patterns or reducing the braking force in a quadratic curve, the control means includes a proportional circuit for generating a voltage signal proportional to the detected diameter of the web roll, a generator circuit for generating an output voltage based on the reduction patterns in response to the voltage signal from the proportional circuit as an input, and a supply circuit for supplying the output voltage from the generator circuit to the braking means.

The aforesaid object is also achieved by a web delivery method according to the present invention, which comprises steps of: continuously detecting the diameter of a web roll; continuously outputting a braking signal corresponding to a braking force to be applied to the web roll, in accordance with the detected diameter of the web roll and operation modes corresponding to the operating conditions of a cigarette manufacturing machine; and applying the braking force to the web roll in response to the braking signal outputted in the outputting step.

According to this delivery method, which naturally has the same advantages of the delivery apparatus described before, the braking force for the web roll is finely controlled for each of the various operation modes in the same manner as in the delivery apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
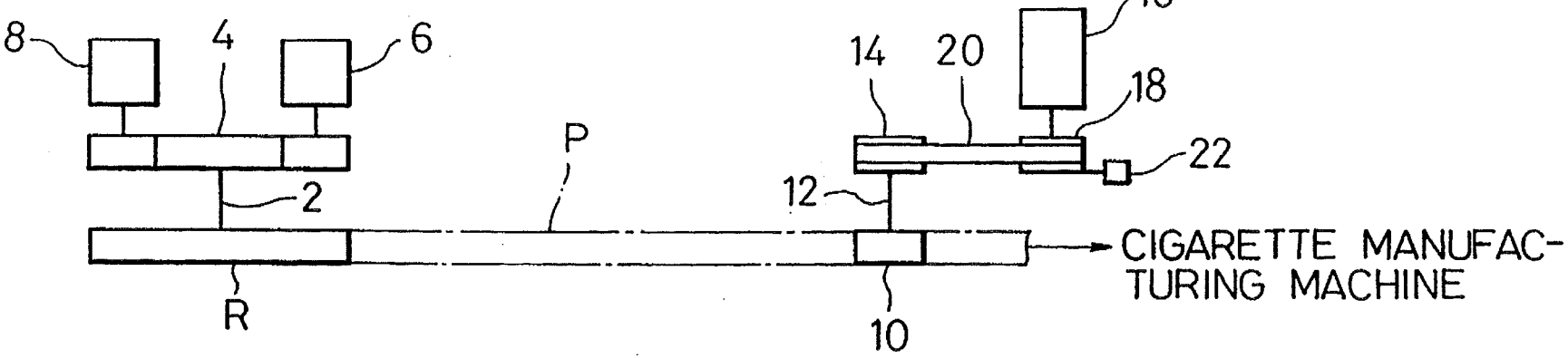
FIG. 1 is a schematic view showing a web delivery apparatus according to one embodiment of the present invention.

Referring to FIG. 1, a web delivery apparatus comprises a horizontal roll shaft 2, which is rotatably supported on a frame (not shown). A paper web roll R is removably mounted on the distal end of the shaft 2. Thus, the roll R can freely rotate around the shaft 2.

A braking disk 4 is mounted on the proximal end of the roll shaft 2, and is provided with a powder brake 6 for use as braking means. The brake 6 serves to apply a predetermined braking force to the braking disk 4.

Since the powder brake 6 is a conventional mechanism, its construction is not illustrated. The following is a brief description of the construction of this brake. The brake 6 includes a fixed member, a rotating member coupled to the braking disk 4, high magnetic permeability powder filling the gap between the two members, and a solenoid coil. When the solenoid coil is energized so that a magnetic field is applied across the gap between the fixed member and the rotating member, the particles of the powder in the gap are attracted to each other by means of a magnetic force, whereby a frictional force is applied between the fixed and rotating members. As the supply voltage for the solenoid coil is controlled, therefore, the powder brake 6i can adjust the frictional force of the rotating member, that is, the braking force for the web roll R.

Moreover, the braking disk 4 is provided with a rotary encoder 8, which generates a given number of pulse signals with every revolution of the disk 4 or the web roll R.

As shown in FIG. 1. a pulling roller 10 is located beside the web roll R The roller 10 is provided with a pinch roller (not shown). A paper web P delivered from the web roll R passes between the pulling roller 10 and the pinch roller, and is fed toward a cigarette manufacturing machine.

The pulling roller 10 has a roller shaft 12, which is fitted with a toothed pulley 14. The pulley 14 is connected to a toothed pulley 18 by means of an endless timing belt 20. The pulley 18 is mounted on the output shaft of a servomotor 16. When the servomotor 16 is driven, its driving force is transmitted to the roller shaft 12, that is, the pulling roller 10, by means of the paired pulleys 14 and 18 and the belt 20, whereby the roller 10 is rotated at a predetermined peripheral speed.

As the pulling roller 10 rotates, the paper web P on the web roll side is pulled to be supplied to the cigarette manufacturing machine. As this is done, the web roll R is rotated so that the web P is delivered therefrom.

The toothed pulley 18 on the servomotor 16 is provided with a timing sensor 22, which generates a timing signal with every revolution of the pulley 18.

Figure 2:
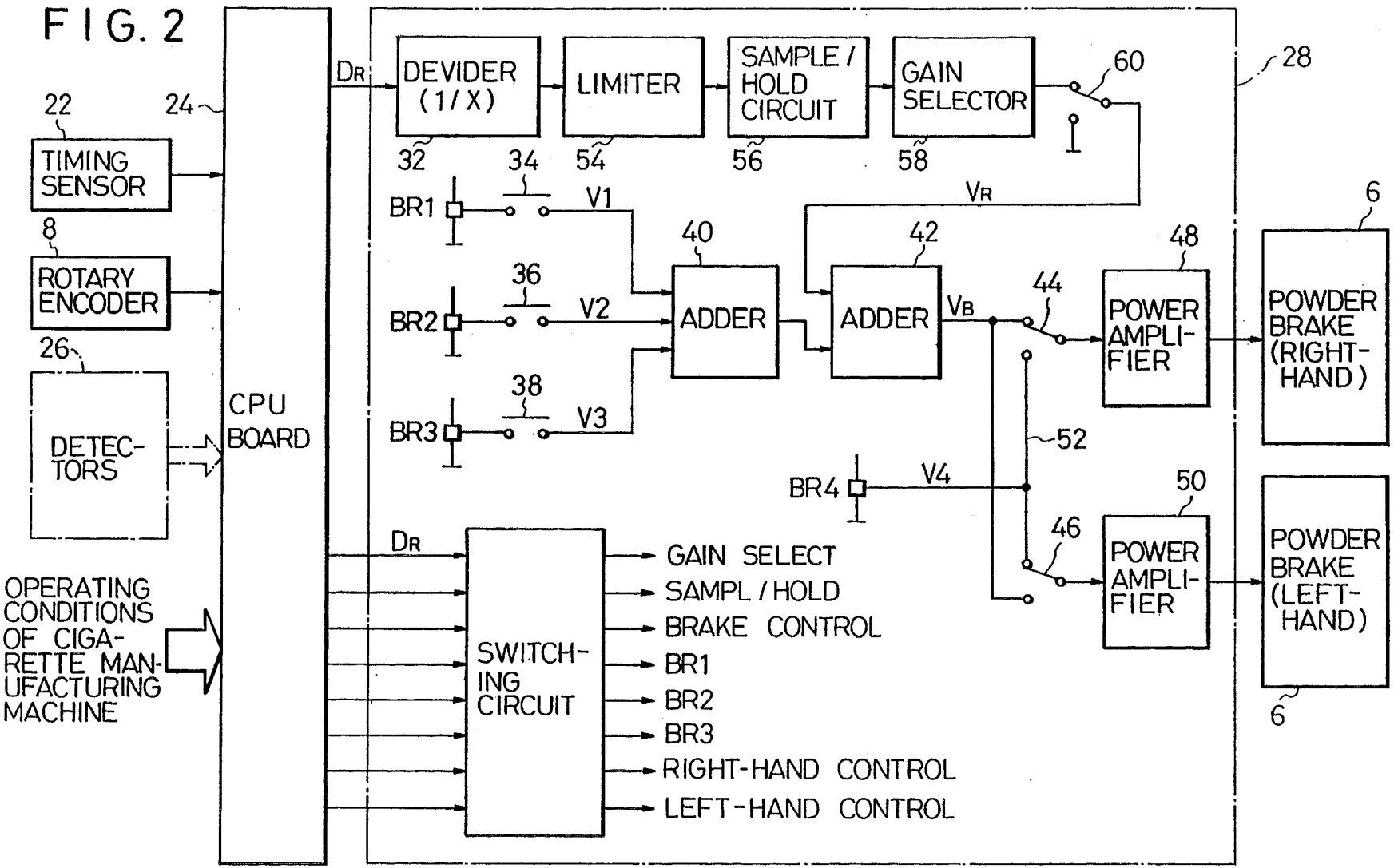
FIG. 2 is a circuit diagram for the control of the braking force of a powder brake shown in FIG. 1.

As shown in FIG. 2, the timing sensor 22 and the rotary encoder 8 are connected electrically to a CPU board 24, which can receive the pulse signals from the encoder 8 and the timing signal from the sensor 22.

The delivery apparatus comprises another web unit (not shown in FIG. 1) similar to the one which includes a roll shaft 2, braking disk 4, powder brake 6, and rotary encoder 8. A detectors 26 of this second web unit, which includes a rotary encoder and a timing sensor, is also connected electrically to the CPU board 24.

The CPU board 24 includes an input/output interface, a central processing unit (CPU), a read- only memory (ROM) stored with control programs and arithmetic programs, and a random access memory (RAM), none of which are shown.

If the paper web P of one of the rolls R is used up, in this case, the web P can be delivered from the other web roll R. Thus, the delivery apparatus can continuously supply the paper web P to the cigarette manufacturing machine.

The following is a detailed description of the way of changing the web rolls.

A connecting device and a reservoir (neither of which are shown in FIG. 1) for the paper web P are arranged between the pair of web rolls R and the pulling roller 10, the connecting device being on the roll side. The leading end of the paper web delivered from the web roll on standby is guided to the connecting device in advance.

If the residue of the paper web P on the one web roll R in a working state runs short, the rotating speed of the servomotor 16 is increased by about 20% for a predetermined period of time. Accordingly, the speed of delivery of the paper web P from the web roll R becomes higher than the running speed of the web P passing through a wrapping section of the cigarette manufacturing machine. Based on the difference between the running speed and the delivery speed, a predetermined length of the paper web P is temporarily stored in the reservoir.

Thereafter, the servomotor 16 lowers its rotating speed and then stops. In this state, the connecting device cuts the paper web P delivered from the working web roll R, and at the same time, the starting end of the paper web P on the standby roll side is connected to the cut end of the delivered web. During this connecting operation, the paper web P stored in the reservoir is continuously supplied to the cigarette manufacturing machine. When the connection is completed, the rotating speed of the servomotor 16 is slowly increased to a predetermined speed, and thereafter, the standby web roll starts to be used as a working web roll, and the paper web P is delivered from the new working roll in like manner. Thus, the cigarette manufacturing machine can perform continuous operation.

When the paper web P is delivered from the web roll R, the peripheral speed of the pulling roller 10 is controlled so that the running speed of the paper web P is equal to the speed of delivery of the web P from the web roll R, and that a predetermined tension is applied to the web P. More specifically, the peripheral speed of the pulling roller 10 is controlled on the basis of the machine speed of the cigarette manufacturing machine, on which the running speed depends, and the position of a pick-off lever (not shown) which moves up and down, depending on the tension of the paper web P in the reservoir.

The cigarette manufacturing machine can adjust the running speed of the paper web P in two stages, thereby also changing the rotating speed of the servomotor 16 in two stages, low- and high-speed modes.

As shown in FIG. 2, the CPU board 24 is connected electrically to the powder brakes 6, which are combined individually with the paired web rolls R, through a control board 28. The CPU board 24 and the control board 28, in conjunction with each other, control the braking force of the powder brakes 6.

Referring now to FIG. 2, braking force control for the powder brakes 6 will be described.

First, the CPU board 24 calculates the diameter of the working web roll R. During the delivery of the paper web P from the web roll R, the current peripheral length of the web roll R and the number of revolutions and diameter of the pulling roller 10 have the relationships given as follows:

$$\pi.D_R=N.\pi.D_K.$$

Here $D_R$, $D_K$ and N represent the current diameter of the web roll R, the diameter of the pulling roller 10, and the number of revolutions of the roller 10.

As seen from the above equation, the current diameter $D_R$ of the web roll R can be calculated by obtaining the number of revolutions of the pulling roller 10 for each revolution of the web roll R.

Thus, the CPU board 24 detects one revolution of the web roll R by counting the pulse signals from the rotary encoder 8, and at the same time, detects the revolution number N of the pulling roller 10 in accordance with the timing signal from the timing sensor 22. Since the diameter $D_K$ of the pulling roller 10 is a fixed value, the CPU board 24 can calculate the diameter $D_R$ of the web roll R according to the above equation by obtaining the one revolution of the roll R and the revolution number N of the roller 10 in this manner.

When the diameter $D_R$ of the web roll R is calculated, the CPU board 24 supplies it to a switching circuit 30 and a divider 32 of the control board 28.

Also, the CPU board 24 is supplied with detection signals from various sensors and switches, which represent the operating state of the whole cigarette manufacturing machine including the delivery apparatus, besides the signals from the rotary encoder 8 and the timing sensor 22. Based on this operating state, therefore, the CPU board 24 supplies a corresponding control signal to the switching circuit 30.

The control board 28 is provided with voltage generator circuits $BR_1$, $BR_2$, $BR_3$ and $BR_4$, which generate supply voltages $V_1$, $V_2$, $V_3$ and $V_4$, respectively, required for controlling the braking voltage of the powder brakes 6. The respective supply voltages of the generator circuits $BR_1$, $BR_2$, $BR_3$ and $BR_4$, which are different from one another, have the following relationships.

$$V_1<V_2<V_3V_4.$$

The voltage generator circuits $BR_1$, $BR_2$ and $BR_3$ are connected to an adder 40 through analog switches 34, 36 and 38, respectively. The adder 40 is connected to a pair of changeover switches 44 and 46 through another adder 42. The switches 44 and 46 are connected to the pair of powder brakes 6 via power amplifiers 48 and 50, respectively.

The changeover switches 44 and 46 are provided with a pair of changeover contacts each. One contact of the switch 44 is connected to one contact of the switch 46 by means of a connecting line 52. The voltage generator circuit $BR_4$ is connected to the line 52.

On receiving the value of the diameter $D_R$ of the web roll R from the CPU board 24, the divider 32 generates a voltage signal proportional to the diameter $D_R$, and supplies it to a limiter 54.

Figure 3:
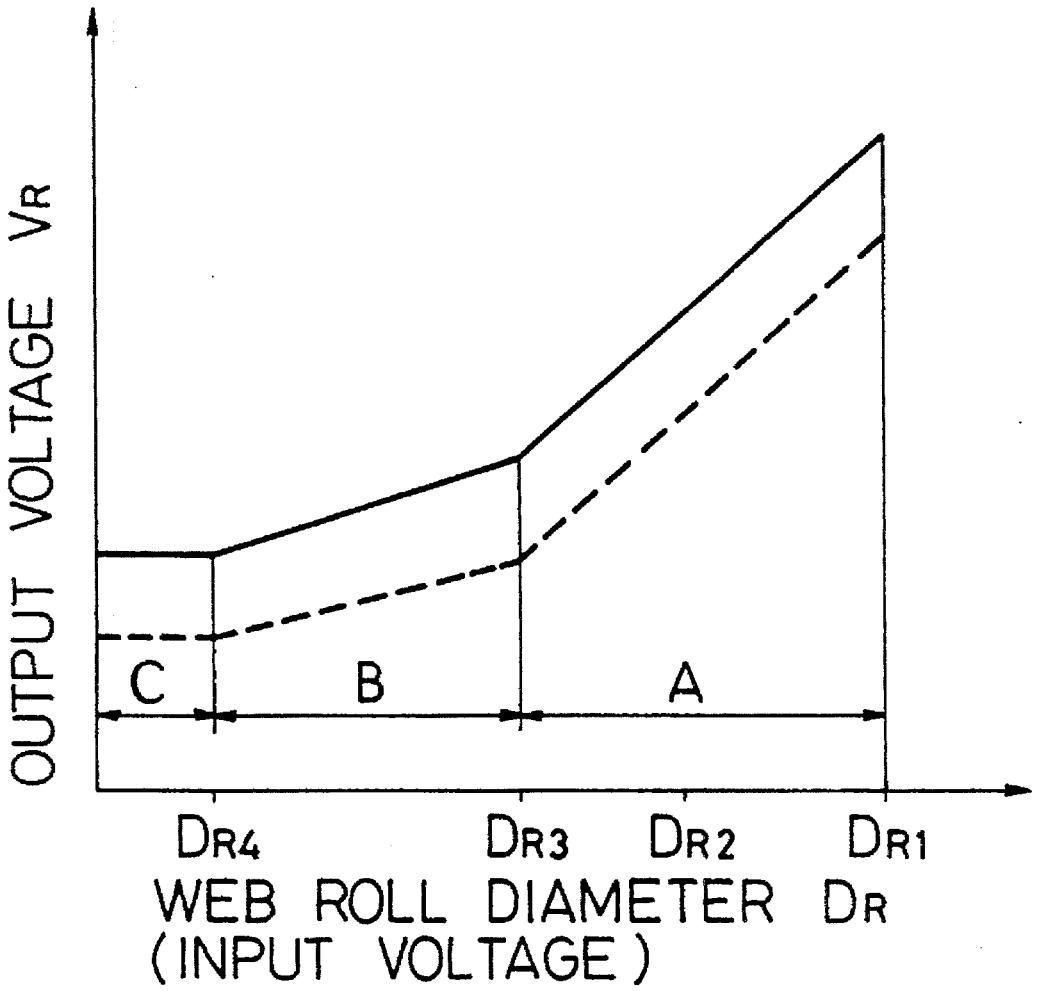
FIG. 3 is a graph for illustrating the function of a limiter shown in FIG. 2.

The limiter 54 includes a function generator, which includes a plurality of operational amplifiers. The limiter 54 has the output voltage characteristic shown in FIG. 3 compared to the voltage signal from the divider 32, that is, the diameter $D_R$ of the web roll R. As is evident from this output voltage characteristic, the-output voltage $V_R$ of the limiter 54 decreases in a fixed proportion as the diameter $D_R$ of the web roll R, which is in one of regions A, B and C, is reduced. However, the rate of reduction of the output voltage $V_R$ has a value in each of the regions A, B and C, the largest in the region A and the smallest in the region C.

The output voltage $V_R$ of the limiter 54 is supplied to a sample/hold circuit 56. The circuit 56 samples the output voltage $V_R$, holds the sampled output voltage for a predetermined period of time, and then supplies it to the adder 42 through a gain selector 58 and a brake control switch 60. The gain selector 58 multiplies the output voltage $V_R$ by a gain which corresponds to high- or low-speed operation of the cigarette manufacturing machine or the delivery apparatus, and supplies the resulting product to the brake control switch 60. The switch 60 is shifted depending on the operation mode of the delivery apparatus.

The following is a description of braking control of the delivery apparatus for each of operation modes corresponding to the operating conditions of the cigarette manufacturing machine, that is, a running mode, stopping mode, and suspension mode for the paper web.

Paper Web Running Mode

Let it be supposed that the cigarette manufacturing machine and the delivery apparatus are in a lowspeed steady operating state when the paper web P is running. In this mode, therefore, the paper web P is slowly delivered from the one web roll R and runs.

As this is done, the switching circuit 30 of the control board 28 delivers a right- or left-hand control signal in accordance with the control signal from the CPU board 24, which is indicative of the operating state.

When the right-hand control signal is outputted, the changeover switch 44 on the side of the powder brake 6 which is combined with the one web roll R is turned on, as shown in FIG. 2, so that the power amplifier 48 and the adder 42 are connected to each other. On the other hand, the changeover switch 46 on the side of the powder brake 6 which is combined with other web roll R is off, and[ the power amplifier 50 is connected to the voltage generator circuit $BR_4$. When the left-hand control signal is outputted, in contrast with this, the switches 44 and 46 are operated the other way around.

Based on the control signal from the CPU board 24, which is indicative of the operating state, the switching circuit 30 delivers a sample/hold signal, gain selecting signal, and brake control signal to the sample/hold circuit 56, gain selector 58, and brake control switch 60, respectively. Based on the sample/hold signal, the sample/hold circuit 56 determines a hold time for the output voltage $V_R$. In this case, the gain selector 58 selects a low-speed gain in response to the gain selecting signal. At this time, moreover, the brake control switch 60 is shifted from its on-position shown in FIG. 2 to its off- position.

In the running mode, the switching circuit 30 connects some of the voltage generator circuits BR and the adder 40 in accordance with the value of the diameter $D_R$ of the working web roll R calculated by the CPU board 24. If the working roll R is a new roll with a diameter $D_{R1}$, the switching circuit 30 turns on the analog switches 34 and 36 of the voltage generator circuits $BR_1$ and $BR_2$, so that the supply voltages $V_1$ and $V_2$ are supplied to the adder 40. In this case, the adder 40 supplies the sum of the voltages $V_1$ and $V_2$ to the adder 42.

Since the brake control switch 60 is off at that time, the output voltage $V_R$ from the limiter 54 cannot be supplied to the adder 42. Accordingly, only the output of the adder 40, that is, the sum $(V_1+V_2)$ of the supply voltages, is supplied to the adder 42, and this sum is the value of a braking voltage $V_B$ delivered from the adder 42.

The braking voltage $V_B$ is supplied from the adder 42 to the right-hand powder brake 6 via the changeover switch 44 and the power amplifier 48, whereupon the brake 6 applies a braking force based on the braking voltage $V_B$ to the working web roll R.

When the diameter $D_R$ of the web roll R is reduced to be $D_{R2}$ or less as the paper web P is delivered from the roll R, the switching circuit 30 turns on the analog switch 36 of the voltage generator circuit $BR_2$ only. Thereupon, the adder 40 supplies only the supply voltage $V_2$ directly to the adder 42. Thus, the braking voltage $V_B$ delivered thereafter from the adder 42 becomes equal to the supply voltage $V_2$.

When the diameter $D_R$ of the web roll R is reduced to be $D_{R3}$ or less, thereafter, the switching circuit 30 turns on the analog switch 34 of the voltage generator circuit $BR_1$ only. In this case, the adder 40 supplies the supply voltage $V_1$ $(<V_2)$ directly to the adder 42, and the braking voltage $V_B$ delivered from the adder 42 becomes equal to the supply voltage $V_1$.

When the diameter $D_R$ of the web roll R is reduced to be $D_{R4}$ or less, moreover, the switching circuit 30 turns off all of the analog switches 34, 36 and 38 of the voltage generator circuits $BR_1$, $BR_2$ and $BR_3$. In this case, no supply voltage is supplied to the adder 42, so that the braking voltage $V_B$ becomes zero, and the braking force of the powder brake 6 for the web roll R is removed.

Figure 4:
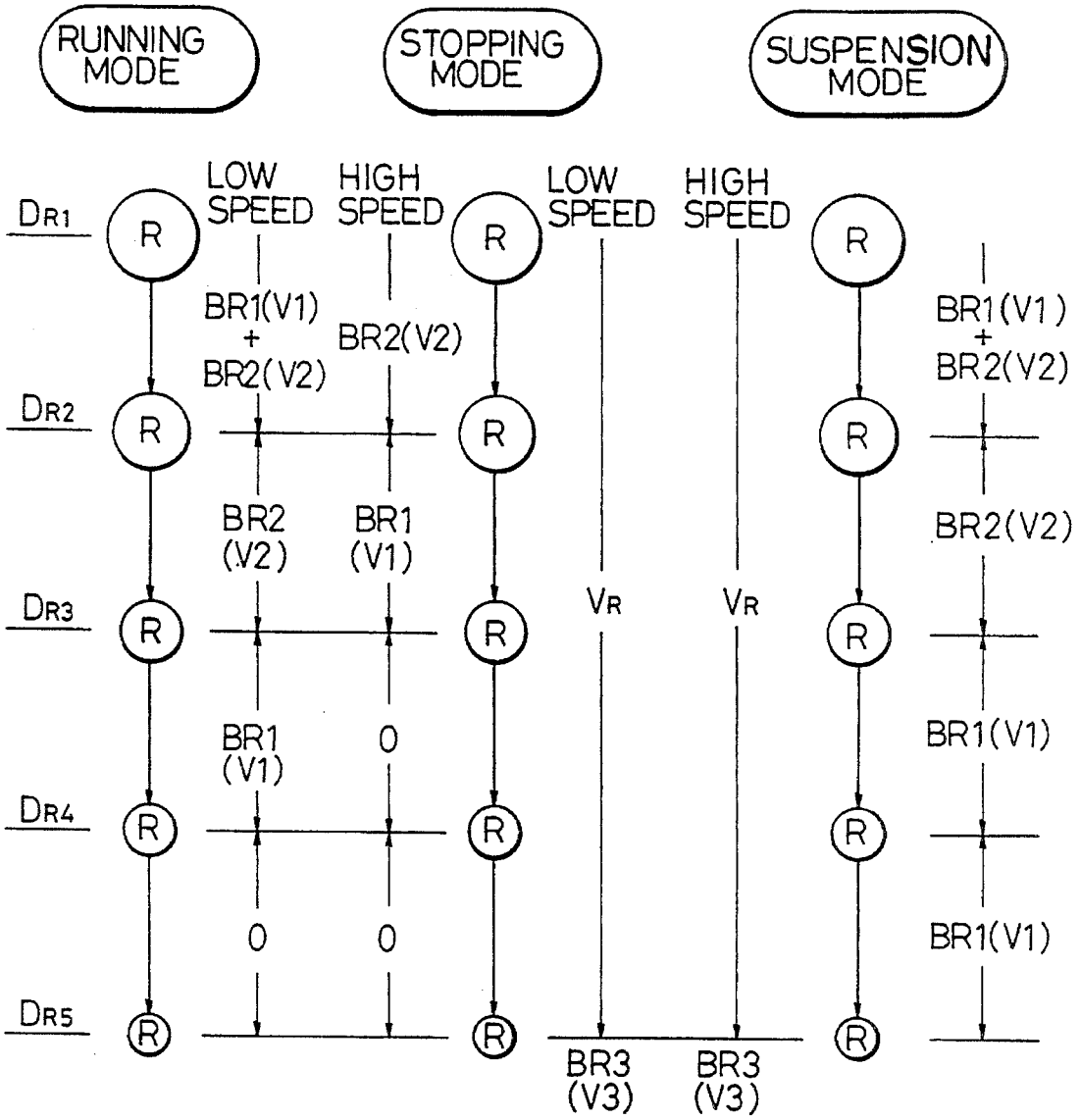
FIG. 4 is a .conceptual diagram showing the way the braking force of the powder brake decreases as the diameter of a web roll is reduced in each operation mode of the cigarette manufacturing machine.

The above description will be more clearly understood when taken in conjunction with the drawing of FIG. 4. FIG. 4 conceptually illustrates the way the diameter of the web roll R decreases as the paper web P is delivered, and also shows the voltage generator circuits BR to be selected as the diameter is reduced in this manner.

Figure 5:
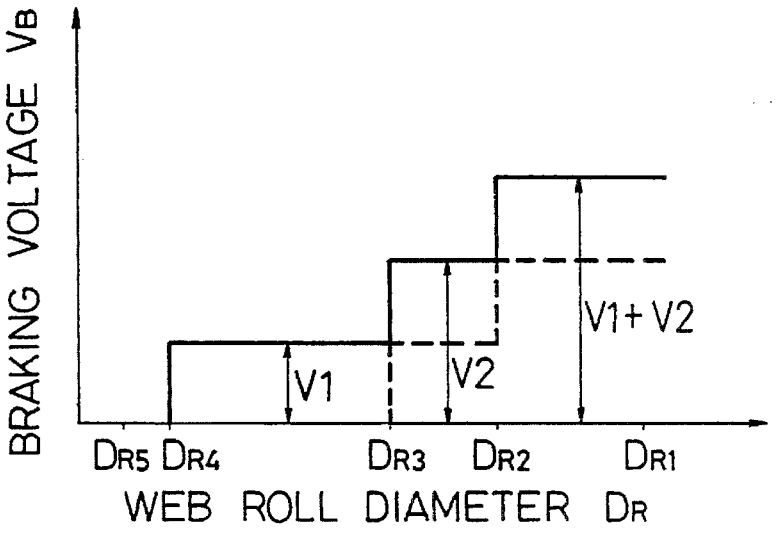
FIG. 5 is a graph showing the reduction characteristic of the braking voltage of the powder brake for a running mode.

If the mass of the web roll R, that is, the rotational force of inertia thereof, is reduced as the diameter $D_R$ of the web roll R decreases, the braking voltage $V_B$ delivered from the adder 42 decreases according to a stepped reduction pattern, as shown in FIG. 5. Accordingly, the braking force of the powder brake 6 also decreases by stages. As the diameter of the web roll R is reduced, therefore, the tension of the paper web P is set properly. In consequence, the paper web P supplied to the cigarette manufacturing machine can steadily run in the wrapping section, so that cigarette rod can be formed accurately.

The running mode shown in FIG. 4 includes a high-speed mode as well as a low-speed mode. FIG. 4 collectively shows the voltage generator circuits BR to be selected in response to the reduction of the diameter of the web roll R in the high-speed mode. During the high-speed mode, the cigarette manufacturing machine and the delivery apparatus are in a steady operating state at a higher speed than in the low-speed mode. Also in this high-speed mode, the voltage supplied to the adder 42 decreases by stages with the reduction of the diameter of the web roll R. As the diameter $D_R$ of the web roll R is reduced, therefore, the braking voltage $V_B$ delivered from the adder 42, that is, the braking force for the roll R, decreases according to the stepped reduction pattern indicated by broken line in FIG. 5.

If the diameter $D_R$ of the web roll R is fixed, the necessary torque for the maintenance of the rotating speed of the roll R is smaller when the roll R is rotating at high speed than when the roll R is rotating at low speed. With the web roll diameter fixed, therefore, the braking voltage $V_B$ delivered from the adder 42, that is, the braking force for the web roll R, is lower in the high-speed mode than in the low-speed mode. In the case of the high-speed mode, the switching circuit 30 switches the gain of the gain selector 58 over to a version for high-speed operation.

Paper Web Stopping Mode

Figure 6:
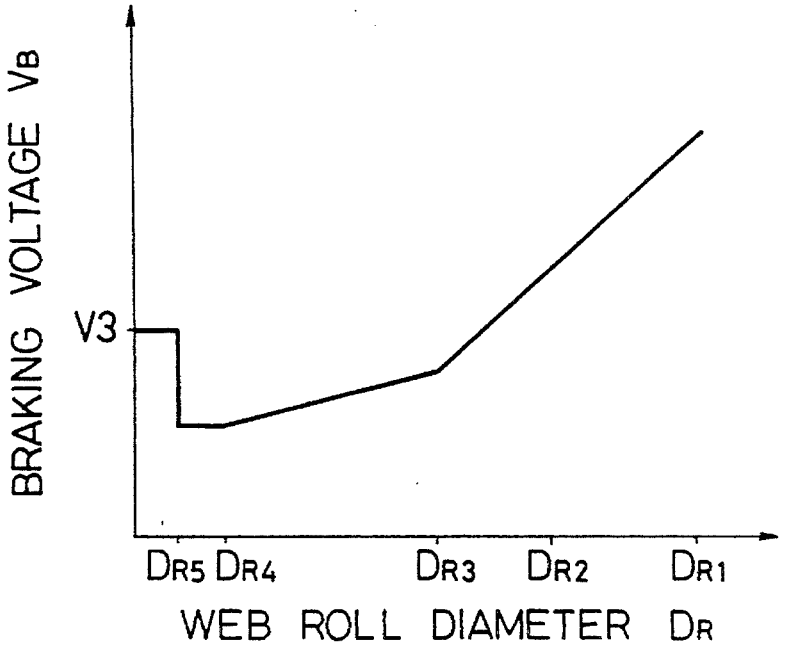
FIG. 6 is a graph showing the reduction characteristic of the braking voltage of the powder brake for a stopping mode.

During this stopping mode, the cigarette manufacturing machine and the delivery apparatus in the steady operating state cease to operate. In this case, the switching circuit 30 turns off all of the analog switches 34, 36 and 38, and turns on the brake control switch 60. During this stopping mode, therefore, the adder 42 is supplied only with the output voltage $V_R$ from the limiter 54, and this voltage $V_R$ serves as the braking voltage $V_B$, As the diameter $D_R$ of the web roll R is reduced, as shown in FIG. 3, the output voltage $V_R$ of the limiter 54 decreases along a pseudo quadratic curve, as shown in FIG. 3, so that the braking voltage $V_B$ also decreases along a reduction pattern represented by a pseudo quadratic curve, as shown in FIG. 6.

When the stopping mode is executed following the low-speed mode, a low-speed gain $G_L$ is given to the gain selector 58. If the gain $G_L$ is 1, the voltage $V_R$ from the gain selector 58 is outputted in accordance with the pseudo quadratic curve represented by full line in FIG. 3. When the stopping mode is executed following the high-speed mode, a high-speed gain $G_H$ (<1) is given to the gain selector 58. In this case, the voltage $V_R$ from the gain selector 58 is outputted in accordance with the pseudo quadratic curve represented by broken line in FIG. 3.

For the aforementioned reason, the output voltage characteristic of the gain selector 58 is changed depending on the preceding operation mode, whether low-or high-speed, in executing the stopping mode.

As the diameter $D_R$ of the web roll R is reduced, on the other hand, the rotational mass of the roll R decreases along a quadratic curve.

Accordingly, the braking voltage $V_B$ delivered from the adder 42, that is, the braking force of the powder brake 6, is reduced following the decrease of the rotational mass of the web roll R. Thus, when the operation mode shifts from the running mode to the stopping mode, the web roll R is subjected to a braking force corresponding to its diameter $D_R$ or rotational mass at that point of time.

As the pulling roller 10 is stopped while gradually lowering its rotating speed during the stopping mode, therefore, the paper web delivery from the web roll R can be stopped without slackening or cutting the paper web P.

This indicates that the paper web P can be supplied to the cigarette manufacturing machine with stability immediately when the operations of the manufacturing machine and the delivery apparatus are restarted, which is highly conducive to improvement of the efficiency of production of the cigarette rod.

If the diameter $D_R$ of the web roll R is $D_{R5}$ or less, as shown in FIGS. 4 and 6, that is, if it is the time for the replacement of the roll R, the roll is replaced with a new one. Thereafter, the switching circuit 30 turns off the brake control switch 60, and turns on the analog switch 38. In this case, therefore, only the supply voltage $V_3$ is supplied to the adder 42 via the adder 40, and the braking voltage $V_B$ delivered from the adder 42 becomes equal to the supply voltage $V_3$.

When the diameter of the web roll R is reduced to $D_{R5}$ or less during the running mode mentioned before, the operation mode is automatically shifted from the running mode to the stopping mode.

Paper Web Suspension Mode

In this suspension mode, the rotation of the pulling roller 10 is kept in suspension after the aforesaid stopping mode is finished. In this case, the switching circuit 30 turns off the brake control switch 60, and alternatively turns on the analog switches 34 and 36, depending on the then diameter $D_R$ of the web roll R.

Figure 7:
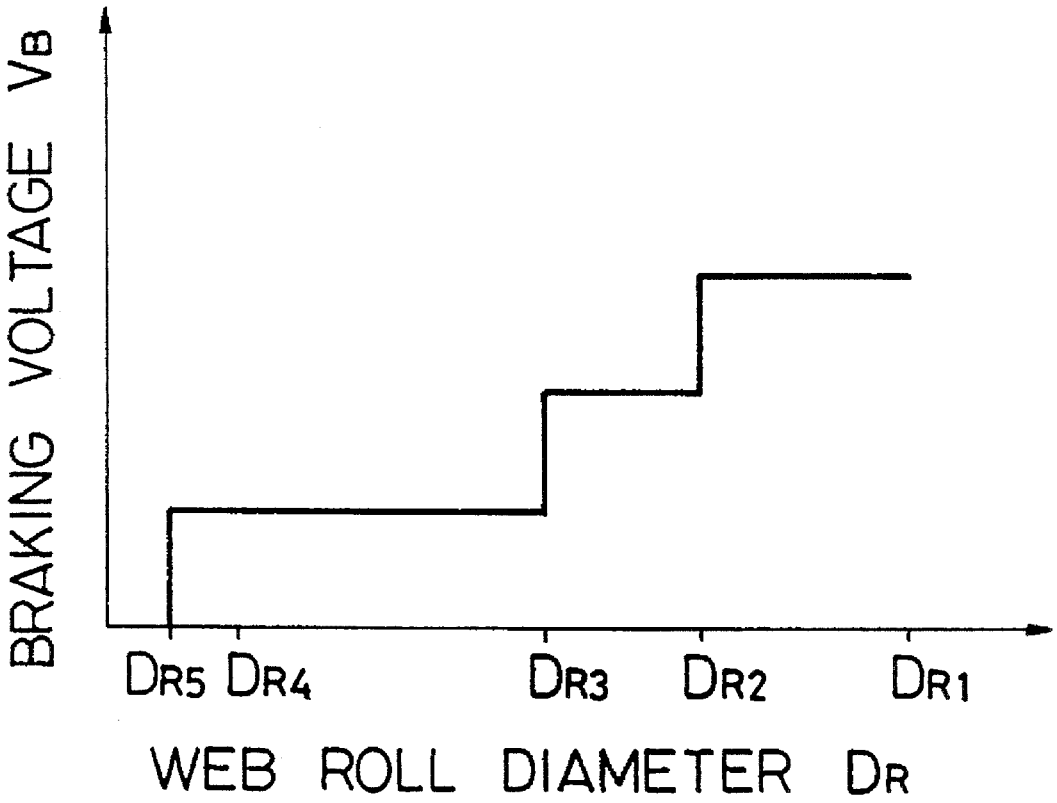
FIG. 7 is a graph showing the reduction characteristic of the braking voltage of the powder brake for a suspension mode.

FIG. 4 shows the voltage generator circuits BR to be selected in accordance with the diameter $D_R$ of the web roll R, as in the case of the running mode described before. FIG. 7 shows the braking voltage $V_B$ applied to the powder brake 6 in accordance with the diameter $D_R$ of the web roll R, that is, the braking force of the brake 6.

When the rotation of the web roll R is stopped, as seen from FIG. 7, the braking force applied to the roll R depends on the diameter $D_R$ thereof, so that the roll R can never rotate unexpectedly.

The supply voltage $V_4$ of the voltage generator circuit $BR_4$ is supplied through the power amplifier 50 to that powder brake 6 which is associated with the other web roll on standby. Thus, the standby web roll is securely kept in a nonrotatable state by the great braking force of the powder brake 6.

It is to be understood that the present invention is not limited to the delivery apparatus according to the one embodiment described above, and that various changes and modifications may be effected therein by one skilled in the art without departing from the scope or spirit of the invention.

According to the one embodiment described above, for example, only the braking force reduction pattern of the stopping mode has the characteristic represented by the pseudo quadratic curve. However, the braking force reduction pattern of the running mode may have a characteristic represented by a quadratic curve.

According to the above-described embodiment, moreover, the limiter 54 is used to obtain the characteristic represented by the pseudo quadratic curve. However, the limiter may be replaced with a map stored in a memory device. Represented on this map are characteristics for reducing the braking voltage along perfect quadratic curves as the diameter of the web roll decreases. In this case, the braking voltage corresponding to the diameter of the web roll is read from the map in the memory device, and the read braking voltage is supplied to the powder brake through the adder 42 and the power amplifier. Thus, the braking force for the stopping mode can be more finely controlled with use of the map.

In the case of the embodiment described herein, furthermore, the braking force of the powder brake is controlled with the braking voltage $V_B$ varied. Alternatively, however, the braking force may be varied by duty-controlling the voltage supply time with the braking voltage for the powder brake constant.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for supplying a cigarette manufacturing machine with a web to be used for the manufacture of cigarettes in a manner such that the web is delivered from a freely rotatable web roll as a pulling roller rotates, comprising:

braking means for applying a braking force to the rotation of the web roll, said braking means being capable of adjusting the braking force;

detecting means for detecting the diameter of the web roll; and control means for controlling the braking force applied to the web roll by said braking means, in accordance with operation modes corresponding to the operating conditions of the cigarette manufacturing machine and the diameter of the web roll detected by said detecting means, wherein the operation modes include a running mode in which the web is delivered from the web roll at constant speed, a stopping mode during which the web delivery is stopped following the running mode, and a suspension mode in which the web delivery is in suspension, the running mode includes a high-speed mode in which the web is delivered from the web roll at high speed and a low-speed mode in which the web is delivered from the web roll at low speed, said control means includes;

braking force reduction patterns determined individually for the operation modes in accordance with the diameter of the web roll, setting means for setting the braking force of said braking means in accordance with the reduction pattern for the current operation mode and the detected diameter of the web roll, braking force reduction patterns corresponding to the high- and low-speed modes, the reduction patterns for the running mode and the suspension mode have characteristics, individually, such that the braking force of said braking means is reduced by stages as the diameter of the web roll decreases; and the reduction pattern for the high-speed mode provides a smaller braking force to be set than the one provided by the reduction pattern for the low-speed mode when the diameter of the web roll is larger than a predetermined value.

2. The apparatus according to claim 1, wherein said braking means includes a roll brake having a braking force for the web roll variable depending on a supply voltage.

3. The apparatus according to claim 2, wherein the roll brake includes a powder brake.

4. The apparatus according to claim 2, wherein said control means further includes a plurality of voltage generator circuits for generating supply voltages, and selecting means for connecting the roll brake and the voltage generator circuit selected in accordance with the reduction pattern of the current operation mode when the current operation mode is the running mode or the suspension mode.

5. The apparatus according to claim 4, wherein the selecting means includes an adder circuit connected to the voltage generator circuits by means of connecting lines, individually, and connected electrically to the roll brake, and switch circuits arranged individually in the connecting lines, the adder circuit adding up the supply voltages from the voltage generator circuits and delivering the sum of the supply voltages to the roll brake.

6. The apparatus according to claim 5, wherein the plurality of voltage generator circuits generate different supply voltages.

7. The apparatus according to claim 6, wherein said control means further includes another voltage generator circuit for generating a supply voltage higher than the supply voltages of the other voltage generator circuits, and a second switching circuit for alternatively connecting the roll brake to the adder circuit and the second voltage generator circuit.

8. The apparatus according to claim 1, wherein said detecting means includes a rotary encoder for delivering pulse signals as the web roll rotates, a timing sensor for generating a timing signal with every revolution of the pulling roller, and arithmetic means for calculating the diameter of the web roll in accordance with the pulse signals and the timing signal.

9. The apparatus according to claim 1, wherein the operation modes include a stopping mode during which the web delivery is stopped following a state in which the web is delivered from the web roll at constant speed; and said control means includes a braking force reduction pattern in a quadratic curve determined in accordance with the diameter of the web roll, and setting means for setting the braking force of said braking means in accordance with the reduction pattern and the detected diameter of the web roll when the current operation mode is the stopping mode.

10. The apparatus according to claim 9, wherein the stopping mode includes a first mode during which the web delivery is stopped following a state in which the web is delivered at high speed, and a second mode during which the web delivery is stopped following a state in which the web is delivered at low speed; and said control means includes different reduction patterns in a quadratic curve for the first and second modes, the reduction pattern for the first mode providing a smaller braking force to be set than the one provided by the reduction pattern for the second mode when the diameter of the web roll is fixed.

11. The apparatus according to claim 10, wherein the setting means includes a proportional circuit for generating a voltage signal proportional to the detected diameter of the web roll, a generator circuit for generating an output voltage based on the reduction patterns in response to the voltage signal from the proportional circuit as an input, and a supply circuit for supplying the output voltage from the generator circuit to the braking means.

12. The apparatus according to claim 11, wherein the generator circuit includes a function generator.

13. The apparatus according to claim 11, wherein the setting means further includes a gain selecting circuit for multiplying the output voltage from the generator circuit by a gain corresponding to the running mode and delivering the resulting products to the supply circuit.

14. The apparatus according to claim 11, wherein the supply circuit includes a sample/hold circuit for sampling the output voltage from the generator circuit, holding the sampled output voltage for a predetermined period of time, and supplying the voltage to said braking means.

15. A method for supplying a cigarette manufacturing machine with a web to be used for the manufacture of cigarettes in a manner such that the web is delivered from a freely rotatable web roll as a pulling roller rotates, comprising steps of:

continuously detecting the diameter of the web roll;

continuously outputting a braking signal corresponding to a braking force to be applied to the web roll, in accordance with the detected diameter of the web roll and operation modes corresponding to the operating conditions of the cigarette manufacturing machine, the operation modes include a running mode in which the web is delivered from the web roll at constant speed, a stopping mode during which the web delivery is stopped following the running mode, and a suspension mode in which the web delivery is in suspension, the running mode includes a high-speed mode in which the web is delivered at high speed and a low-speed mode in which the web is delivered at low speed; and applying the braking force to the web roll in response to the braking signal outputted in the outputting step, said outputting step includes a process of outputting the braking signal lowered by stages depending on the detected diameter of the web roll when the current operation mode is the running mode or the suspension mode, said outputting step further includes a process of making the braking signal outputted in the high-speed mode lower than the one outputted in the low-speed mode when the diameter of the web roll is larger than a predetermined value.

16. The method according to claim 15, wherein said outputting step includes a process of outputting the braking signal lowered in a quadratic curve depending on the detected diameter of the web roll when the current operation mode is the stopping mode.

17. The method according to claim 16, wherein the stopping mode includes a first mode during which the web delivery is completely stopped following a state in which the web is delivered at high speed, and a second mode during which the web delivery is completely stopped following a state in which the web is delivered at low speed; and said outputting step includes a process of making the braking signal outputted in the first mode lower than the one outputted in the second mode when the diameter of the web roll is fixed.

* * * * *